United States Patent [19]

Verclyte

[11] Patent Number: 4,909,283

[45] Date of Patent: Mar. 20, 1990

[54] TUCKING-IN DEVICE FOR WEAVING MACHINES

[75] Inventor: Eddy Verclyte, Ypres, Belgium

[73] Assignee: Picanol N. V., Ypres, Belgium

[21] Appl. No.: 239,679

[22] Filed: Sep. 2, 1988

[30] Foreign Application Priority Data

Sep. 2, 1987 [BE] Belgium ..... 8700987

[51] Int. Cl.[4] ..... D03D 49/00

[52] U.S. Cl. ..... 139/1 C; 139/434

[58] Field of Search ..... 139/1 C, 434

[56] References Cited

U.S. PATENT DOCUMENTS 3,425,461 2/1969 Berry .
3,951,177 4/1976 Santucci ..... 139/434
4,103,714 8/1978 Hasebe .
4,543,999 10/1985 Deborde et al. .
4,546,799 10/1985 Riesen ..... 139/1 C
4,566,497 1/1986 Schachenmann .
4,676,277 6/1987 Gillespie et al. ..... 139/1 C

FOREIGN PATENT DOCUMENTS 893142 5/1982 Belgium .
2505885 8/1982 France .

*Primary Examiner*—Henry S. Jaudon
*Attorney, Agent, or Firm*—Bacon & Thomas

[57] ABSTRACT

A tucking-in device for weaving machines includes a thread clamp (10) for gripping the free ends (16) of inserted weft threads (4), and a tucker arm (12) for drawing the thread ends (16) from the closed clamp (10) back into the shed (6). The tucking-in device includes a pneumatic cleaning mechanism (14) for cleaning at least the thread clamp (10) by means of an air jet (15).

3 Claims, 2 Drawing Sheets

TUCKING-IN DEVICE FOR WEAVING MACHINES

BACKGROUND OF THE INVENTION

1. Field of the Invention

This invention generally concerns a tucking-in device for weaving machines, i.e. and, more specifically, an apparatus to bend over the cutoff ends of weft threads which have been inserted into the shed of the weaving machine, to then tuck them back into the shed so that thread ends are woven into the cloth.

2. Description of the Invention

Tucking-in devices of various kinds are known and are comprehensively described in, for example Belgian Patent No. 893,142 and U.S. Pat. No. 3,425,461. Such tucking-in devices consist essentially of a thread clamp mounted at the side of the cloth operating in conjunction with a cutting device or shears, and a tucker arm which can be introduced into the shed and which can operate on the leading end of the beaten-up weft thread. In operation, the leading end of the beaten-up weft thread enters the thread clamp, the excess length of the leading end is cut off by a weft cutter, and, after the shed has crossed over, the leading end of the weft thread is then drawn back into the shed by means of said tucker arm and woven in with the next weft thread. Such a tucking-in device is usually mounted at both sides of the cloth.

In such tucking-in devices, since the leading end of the weft thread is pulled out of the closed thread clamp by the above-mentioned tucker arm, a number of short fibers will usually be left behind in the clamp, with the result that after a certain time the thread clamp will become fouled and will no longer work properly. Also, other moving parts of such a tucking-in device can become fouled by the presence of weaving dust.

SUMMARY OF THE INVENTION

The present invention provides a tucking-in device for weaving machines that entirely avoids the above-mentioned disadvantages. The invention concerns a tucking-in device consisting of at least one thread clamp in order to grip the free thread ends of the weft threads, and a tucker arm to draw the thread ends back into the shed, characterized in that the device has a pneumatic cleaning mechanism which can clean at least the thread clamp by means of an air jet. In a preferred embodiment, the pneumatic cleaning mechanism consists of at least one blower whose nozzle is directed towards the thread clamp.

The blower should preferably be controlled so that, for example, after a certain number of weaving cycles, an air jet is sent through the thread clamp at the moment that the latter opens to remove short fibers and pieces of fluff. In a specific embodiment, the thread clamp is also provided with a control mechanism so that it can be opened at the correct moment in order to enable it to be cleaned.

BRIEF DESCRIPTION OF THE DRAWINGS

In order to describe the characteristics of the invention, by way of example only and without being limitative in any way, the following preferred embodiments are described with reference to the accompanying drawings, where.

DETAILED DESCRIPTION OF THE PREFERRED EMBODIMENT

Figure 1:
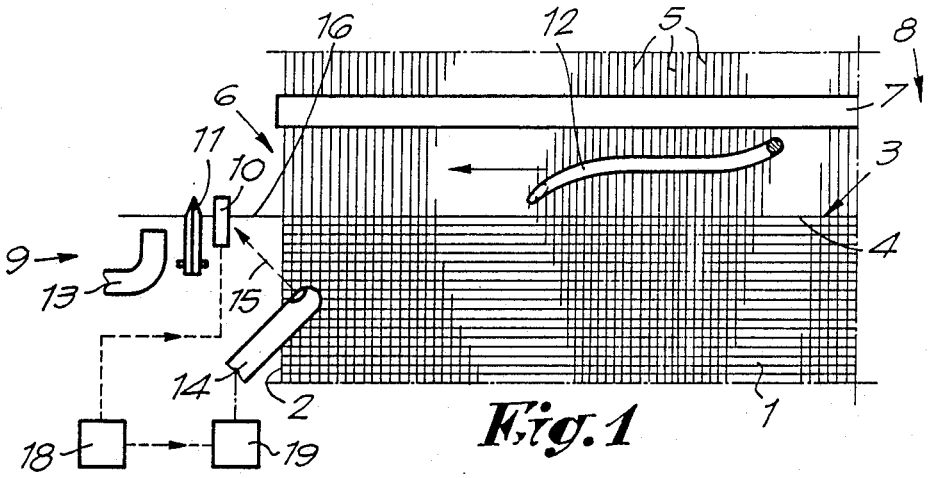
FIGS. 1 to 3 are a schematic representation of the tucking-in device and its operation.

FIG. 1 is a schematic view looking down on the woven cloth 1 in a weaving machine. Also shown schematically are the edge of the cloth 2, the cloth fell 3, the weft thread last beaten up 4, the warp threads 5, the shed 6 and the reed 7. The picking side is indicated by 8. The tucking-in device 9 is mounted beside the cloth edge 2 and consists essentially of a thread clamp 10, a cutting device such as a weft cutter 11 and a tucker arm 12 whose purpose will be described below. If required, the tucking-in device 9 may also be provided with a suction nozzle 13 in order to remove thread ends.

A particular characteristic of the invention is that the tucking-in device 9 is provided with a pneumatic cleaning device, blower 14. Blower 14 generates an airjet 15 which enables at least the above-mentioned thread clamp 10 to be cleaned.

The tucking-in device described above works essentially as follows.

Figure 2:
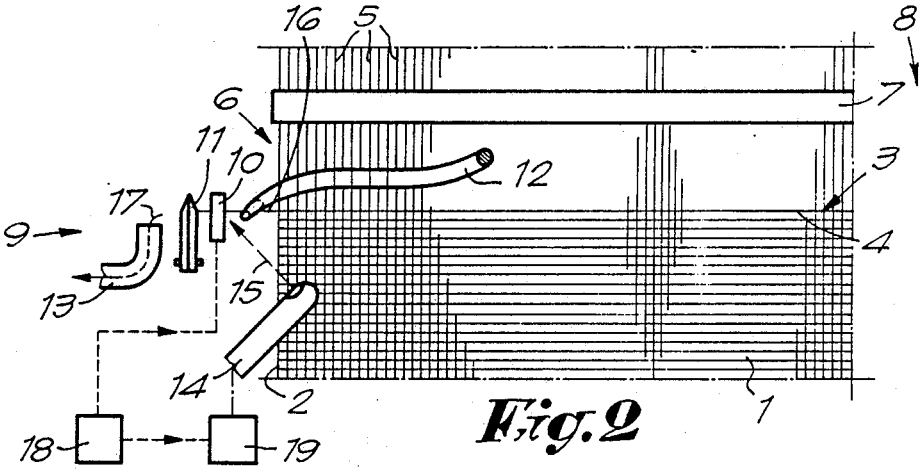

As shown in FIG. 1., a weft thread 4 is beaten up between the warp threads 5, so that the thread end 16 is pushed into the thread clamp 10. At that moment the weft cutter 11 is activated, with the result that, the weft thread 4 is always cut off to the same length, and, as shown in FIG. 2, the thread end 17 is removed by the suction nozzle 13. Meanwhile, the tucker arm 12 is presented through the top warp sheet or bottom warp sheet into the shed 6, so that the weft thread 4 is gripped at the thread end 16, between the cloth edge 2 and the closed thread clamp 10, as shown in FIG. 2.

Figure 3:
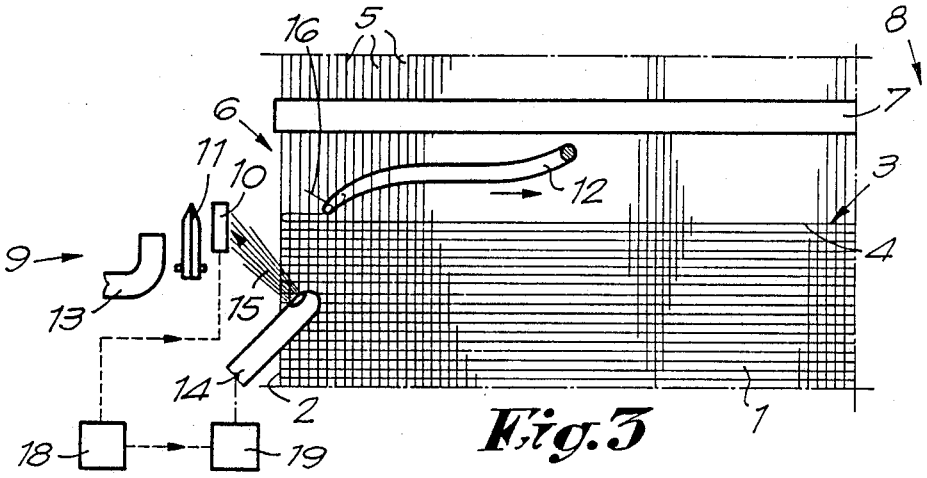

As shown in FIG. 3, the thread end 16 is pulled out of the thread clamp 10 and brought back into the shed. Obviously, tucking in occurs after crossover of the shed, otherwise the whole weft thread 4 would be pulled out from the cloth fell 3. Subsequently, the tucker arm 12 is removed from the shed and a new weft thread can be inserted into the shed. The above-mentioned thread end 16 is then woven in with the next weft thread.

After the weft thread 4 has been pulled out of the clamp 10, the clamp is opened and the blower 14 is activated. Activation may occur after each weaving cycle, after a number of weaving cycles, or after any desired period of time, so that the fibers remaining in the thread clamp 10 are blown away. The blower can also be directed towards several other components so that they may be cleaned as well.

Where a thread clamp 10 is used which is biased closed by an elastic device is used, i.e. one which does not automatically come into the open position, a control mechanism 18 may be used, so that the clamp 10 is opened briefly at suitable moments, and so that at these moments the pneumatic valve 19 of the blower 14 is also opened.

The blower 14 should preferably be oriented in such a way that weaving dust, short fibers and suchlike are always blown away from the warp threads 5 and from the cloth 1, so that the latter does not become fouled.

Figure 4:
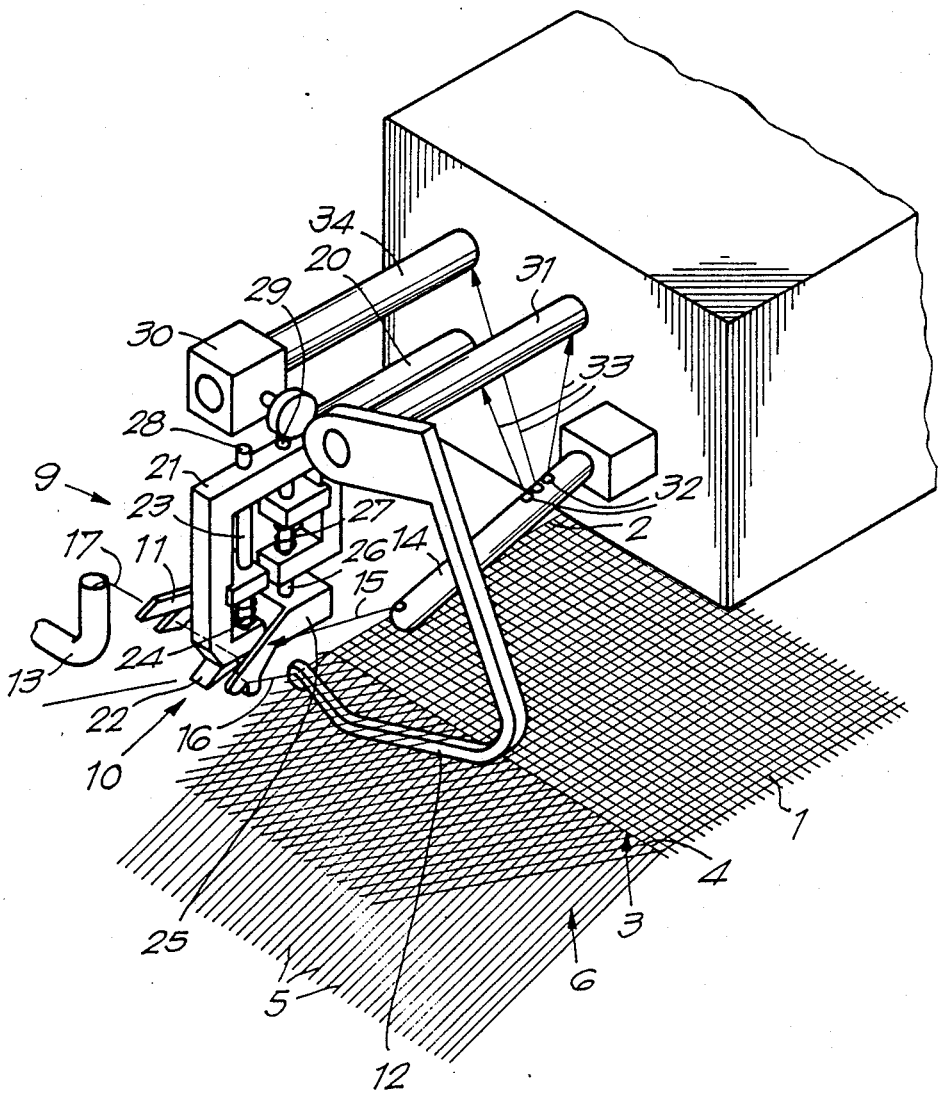
FIG. 4 shows a practical embodiment of the invention.

FIG. 4 is a perspective drawing of another practical embodiment of the tucking-in device according to the invention. The following description is based on the tucking-in device already known from BE 893,142, but without being limited to use with that device. The weft cutter 11 and the suction nozzle 13 are shown here schematically. Thread clamp 10 is mounted on bracket 21 beside the weft cutter 11, which can slide on a bar 20 in the direction of the warp threads 5. The thread clamp 10 has a movable jaw 22 which can be moved within the bracket 21 by means of a pin 23 and which is biased in its closed position by means of a spring 24. Beside the thread clamp 10 is a sliding block 25 which can move up and down, by means of which the thread end 16 can be brought into a defined position relative to the open shed 6. This sliding block 25 moves vertically within the bracket 21 by means of a pin 26 and is biased upward by a spring 27.

The ends 28 and 29 of both pins 23 and 26 stick out of the bracket 21, so that they can be pressed downwards against the pressure of springs 24 and 27 respectively by means of a bumper mechanism 30 mounted on a sliding shaft 34, thus opening the thread clamp 10 and operating the sliding block 25 respectively.

The tucker arm 12 is swivel-mounted on a shaft 31 in such a way that it can be presented between the warp threads 5, as shown in FIG. 4.

A special characteristic of the invention is that between the above-mentioned components of the tucking-in device 9 there is a pneumatic cleaning device, which in the embodiment illustrated consists of the blower 14. This blower 14 provides at least one air jet 15 by means of which the thread clamp 10 can be cleaned. The blower also has a number of nozzles 32 which provide supplementary airjets 33 in order to clean various other components, such as the shaft 31, the bar 20, the shaft 34, etc.

The operation of the device shown in FIG. 4 is essentially as described with reference to FIGS. 1 to 3 with respect to the timing of the blower operation.

When the bumper mechanism makes contact with the end 28 of the pin 23, the thread clamp 10 is opened. At that moment, the blower 14 may also be briefly activated, so that any short fibers present in the thread clamp are blown away, and so that the other components mentioned above are cleaned of dust.

In the following step, a weft thread 4 is inserted into the shed 6 so that its end 16 is led through the thread clamp 10. The thread clamp 10 is closed by the appropriate movements of the bracket 21 and/or bumper mechanism 30.

The superfluous thread end is cut off by the weft cutter 11, as mentioned above, after which the shed crosses over so that the weft thread 4 is woven in. Subsequently, the slide block 25 is moved downwards by the appropriate movements of the bracket 21 and/or the bumper mechanism 30, so that thread end 16 is presented centrally in front of the shed 6. The thread end is then gripped by the tucker arm 12.

When the tucker arm 12 moves back, the thread end 16 is drawn back into the shed as described above, after which it can be woven in with the following weft thread.

Clearly, the blower 14 does not have to be activated every weaving cycle; it is sufficient for it to be activated after a certain time interval or after a certain number of weaving cycles. The tucking-in device can of course be equipped with more than one blower, and the blower can also operate continuously to prevent weaving faults caused by thread fragment fouling.

The present invention is not limited to the examples described and the embodiments shown in the drawings; on the contrary such a tucking-in device for weaving machines, which is equipped with a pneumatic cleaning mechanism, can be made in all forms and dimensions while still remaining within the scope of the invention.

I claim:

1. A device for tucking the free end of an inserted weft thread back into the shed of a weaving machine, comprising:

a thread clamp means having open and closed positions and arranged to grip the free end portion of an inserted weft thread when in the closed position;

a weft cutter means for cutting the end section of said free end portion of the inserted weft thread to leave a predetermined length of free end portion of said inserted weft thread adjacent said clamp means;

weft end remover means for removing the cut end section of the inserted weft thread from the weft cutter means;

tucker arm means arranged to engage and draw said weft free end portion back toward the shed while the clamp means is in its closed position so that said free end portion of said inserted weft thread is freed from said clamp means;

pneumatic blower means including at least one blower nozzle for directing an air jet toward said clamp means at least when the clamp means is in the open position whereby said clamp means can be cleared of weft thread fibers and weaving dust during operation of the weaving machine.

2. A tucking device as claimed in claim 1, wherein said pneumatic blower means comprises at least one additional blower nozzle for directing additional air jets to other components of the tucking device.

3. A tucking device as claimed in either of claims 1 or 2, wherein said at least one blower nozzle is arranged to direct the air jet away from the shed area.

* * * * *